United States Patent [19]

Wielgus

[11] Patent Number: 4,493,955

[45] Date of Patent: Jan. 15, 1985

[54] CONTROL MECHANISM FOR AN ELECTRIC MOTOR ASSEMBLY

[75] Inventor: Charles D. Wielgus, Crystal Lake, Ill.

[73] Assignee: Colman OEM, Inc., Rockford, Ill.

[21] Appl. No.: 486,203

[22] Filed: Apr. 18, 1983

[51] Int. Cl.[3] ..... H01H 43/10

[52] U.S. Cl. ..... 200/38 R; 339/102 R

[58] Field of Search ..... 200/38 R, 153 LA, 153 LB, 200/38 A, 38 F, 38 FA, 38 FB, 38 B, 38 BA, 38 C, 38 CA, 38 D, 38 DA, 38 DB, 38 DC, 38 E, 153 T; 74/568 T; 339/218 R, 102 R

[56] References Cited

U.S. PATENT DOCUMENTS

| | | | |
|---|---|---|---|
| 1,831,605 | 11/1931 | Porter | 200/38 F |
| 3,144,537 | 8/1964 | Kiwi | 200/153 T |
| 3,230,312 | 1/1966 | Catto et al. | 179/6.16 |
| 3,515,831 | 6/1970 | Church et al. | 200/153 LB |
| 3,521,442 | 7/1970 | Umezawa | 200/38 R X |
| 3,814,874 | 6/1974 | Brown | 200/38 B |
| 4,045,626 | 8/1977 | Holper | 200/30 R |

FOREIGN PATENT DOCUMENTS

| | | | |
|---|---|---|---|
| 949614 | 2/1964 | United Kingdom | 200/38 A |

*Primary Examiner*—A. D. Pellinen

*Assistant Examiner*—Morris Ginsburg

*Attorney, Agent, or Firm*—Kinzer, Plyer, Dorn & McEachran

[57] ABSTRACT

A control mechanism in combination with an electric motor assembly in which an output shaft having a cam surface is connected to the electric motor through a gear train located in a housing. A switch block assembly is on the housing. First and second arms extend from the switch block assembly with the first arm having a contact near the free end thereof and the second arm intersecting the first arm. The second arm rides on the cam surface of the output shaft and has a contact which moves in and out of engagement with the contact of the first arm. The first and second arms are disengaged when the output shaft begins a cycle of rotation and are engaged when it completes the cycle. The switch block assembly includes a base formed integrally with the gear train housing. The base has posts and a central block located between the posts. A switch top includes a pair of blocks, a cross member connecting the blocks and a passage formed in each block. The passages receive the posts of the base with the cross member resting on the base center block. Slots are formed in the cross member between the base and the blocks. Quick connect terminals extend through the slots.

4 Claims, 4 Drawing Figures

CONTROL MECHANISM FOR AN ELECTRIC MOTOR ASSEMBLY

BACKGROUND AND SUMMARY OF THE INVENTION

This invention is directed to a control mechanism for a cyclically operable electric motor assembly which can be used to control a helical feed of a vending machine.

The present invention is disclosed principally in connection with small (sub-fractional horsepower) direct current electric motors used in vending machines and which are controlled by a microprocessor although the invention may be applied equally well to other purposes where the principle is applicable.

Certain kinds of vending machines employ one or more small electric motors to control delivery of the products sold by the machines. In one form of vending machine, packaged products are delivered by what amounts to a large helical (spring) feeder mounted on a shaft driven by a small electric motor. Previously, the electric motors were of the alternating current type powered by 110 volts alternating current. These motors are now being replaced by low voltage direct current electric motors which may be more easily controlled by a microprocessor.

When proper coinage is inserted in the vending machine, a circuit for the microprocessor is actuated to energize the motor. The motor remains energized until the helical feeder has delivered the product. When the delivery is complete, the motor is stopped by shorting the circuit for the microprocessor.

These vending machine motors are small and usually include a gear train for speed reduction with the gear train located in a housing. As previously constructed, the alternating current motors had gear trains in metal housings. A microswitch was fastened to the metal housing by screws and a metal pawl was operatively connected between the output gear of the gear train and the microswitch in order to operate the microswitch at the beginning and end of each revolution of the output gear. This construction required expensive parts and was costly and time consuming to assemble.

Therefore, it is an object of this invention to provide a control mechanism for an electric motor assembly in which the switch mechanism for completing and interrupting the microprocessor can be integrally mounted on the gear housing by heat staking the switch block to the gear housing.

Another object is to reduce the cost of construction of small electric motor assemblies by forming the quick connect terminals integrally with the switch contact blades.

Another object of this invention is a switch mechanism having contact blades which employ cross point contacts with a large amount of wiping action.

Other objects may be found in the following specification, claims and drawings.

BRIEF DESCRIPTION OF THE DRAWINGS

The invention is illustrated more or less diagrammatically in the following drawings wherein.

DESCRIPTION OF THE PREFERRED EMBODIMENT

Figure 1:
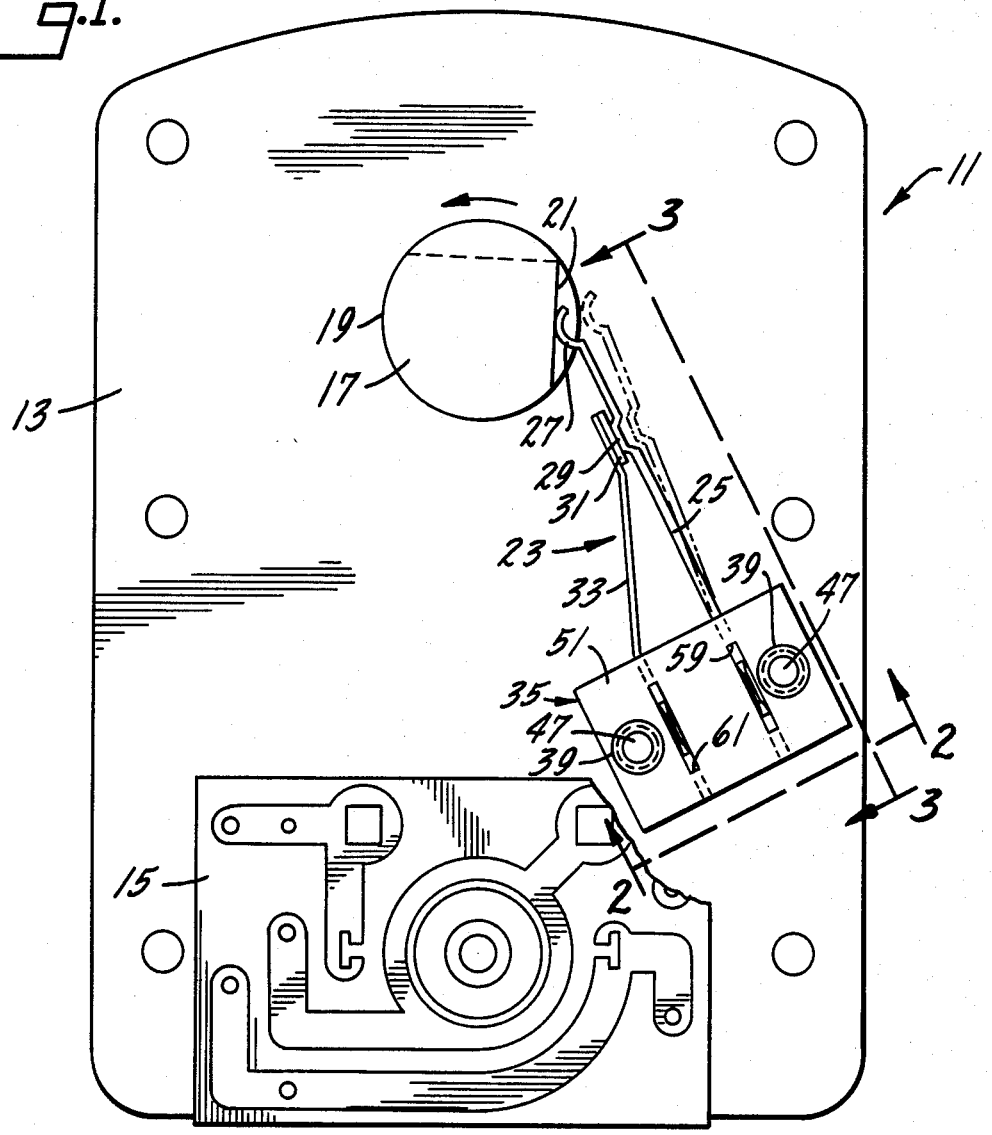
FIG. 1 is an end elevational view of the motor and gear train assembly of this invention with some parts broken away and a moved position of some of the parts shown in dashed lines.

FIG. 1 of the drawings shows an electric motor and gear train housing assembly 11 of the type intended to operate a helical feeder for a vending machine of the type shown in U.S. Pat. No. 4,045,626. The assembly 11 includes a gear train housing 13 preferably molded of a thermoplastic material as well as a printed circuit board 15 and a direct current motor (not shown) mounted between the gear train housing 13 and the printed circuit board 15. The gear train housing 13 has an output shaft, the opposite end 17 of which is shown in the drawings. The end 17 of the output shaft has a cam surface 19 which is circular with a flattened surface 21 formed as part thereof.

Figure 2:
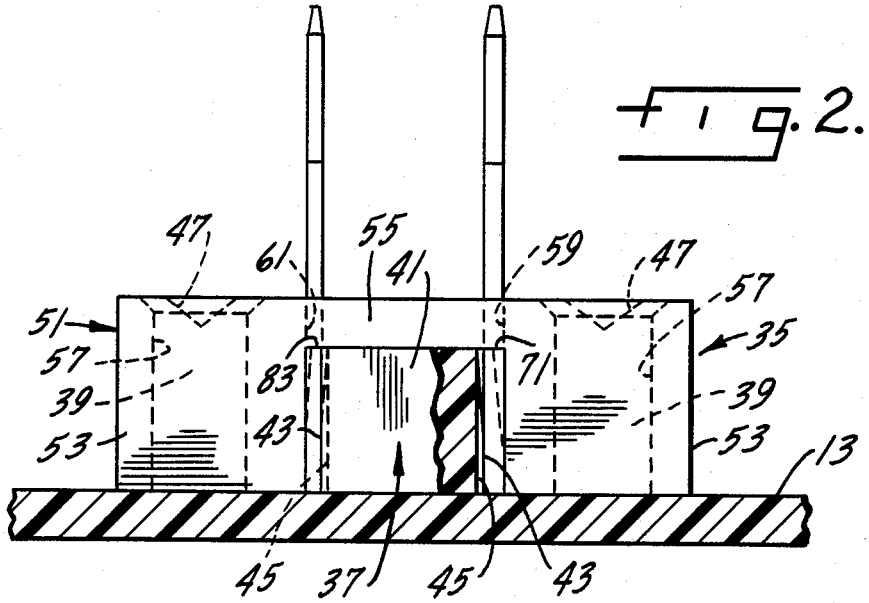
FIG. 2 is an enlarged view in partial cross-section of the gear train housing and the switch taken along line 2—2 of FIG. 1.

A control switch assembly 23 is located on the gear train housing adjacent the printed circuit board 15. An actuator or first arm 25 of the control switch has a curved tip 27 which rides on the cam surface 19 of the end 17 of the output shaft. The actuator arm 25, which is shown in detail in FIG. 3 of the drawings, has an offset surface 29 formed inwardly of its curved tip 27. This offset contact is moved in and out of engagement with a contact 31 formed at the end of a contact spring 33 shown in detail in FIG. 4 of the drawings. The contacts 29 and 31 wipe each other during engagement and disengagement. The actuator arm 25 and contact spring 33 are mounted in a switch block assembly 35 shown in detail in FIG. 2 of the drawings.

The switch block assembly 35 includes a base portion 37 which is formed integrally with the gear train housing 13. The base portion includes a pair of cylindrical shaped upstanding posts 39 and a center block 41 of generally rectangular shape located between the posts. The side walls 43 of the center block which face the posts have notches 45 cut therein which extend the entire height of the block and a portion of the length thereof. Conical depressions 47 are formed in the top of the posts.

The switch block assembly 35 also includes a top portion 51 which is formed in a separate piece and includes a pair of rectangular blocks 53 joined by a cross member 55. A passage 57 of circular cross section is formed in each block and is dimensioned so as to receive a post 39 of the base portion 37 of the switch block assembly in close fitting relation. A pair of rectangular slots 59 and 61 extend through the cross member 55 with each slot located adjacent a rectangular block 53 of the top portion. When the top portion 51 rests on the center block 41 of the base portion of the switch block assembly, the slots 59 and 61 will open into the spaces between the posts 39 and the center block 41 of the base portion.

Figure 3:
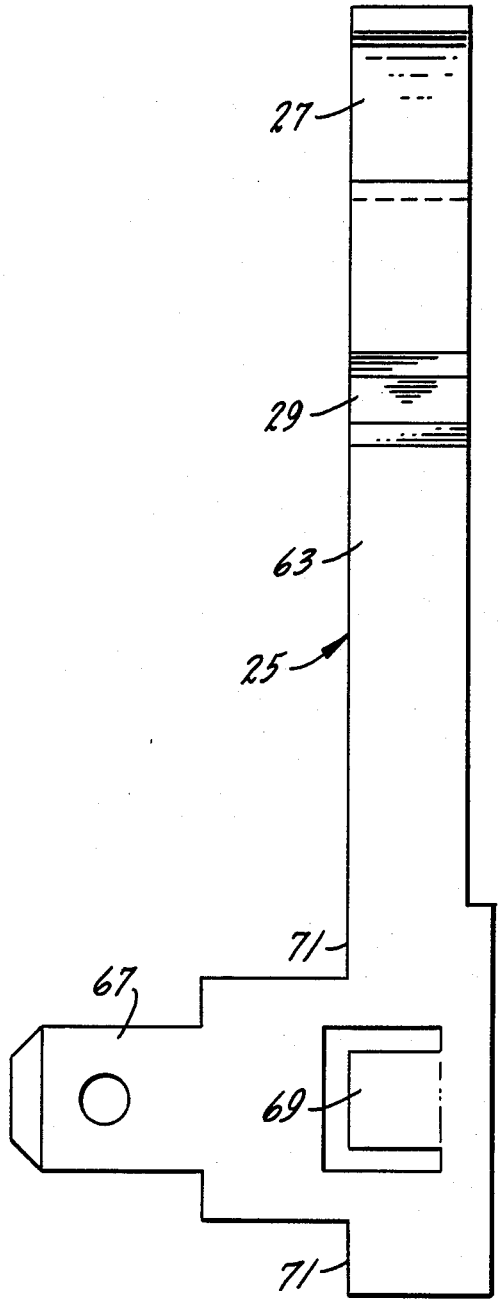
FIG. 3 is an enlarged plan view of the actuator arm of the switch mechanism, as viewed along line 3—3 of FIG. 1.

The actuator arm 25 shown in detail in FIG. 3 of the drawings is a generally flat somewhat L-shaped member formed of a phosphorous bronze material for its wearing qualities and good electrical conductivity. The curved tip 27 and offset switch contact surface 29 are located on the arm portion 63 of the L and a quick connect terminal 67 is located on the leg of the L. An offset tab 69 is located at the corner of the L-shaped actuator arm and this tab is positioned to fit into one of the notches 45 formed in the center block 41 of the base portion 37 of the switch block assembly. A shoulder 71 is formed on the arm portion 63 on opposite sides of the terminal portion 67 and the shoulder 71 engages the underside of the cross member 55 of the top portion 51 of the switch block assembly. In the construction shown in the drawings, the terminal portion 67 of the actuator arm 25 fits through the rectangular slot 59 formed in the cross member 55 of the top portion 51 of the switch block assembly and the arm portion 63 extends out of the side of the switch block assembly located at right angles to the slot 59.

Figure 4:
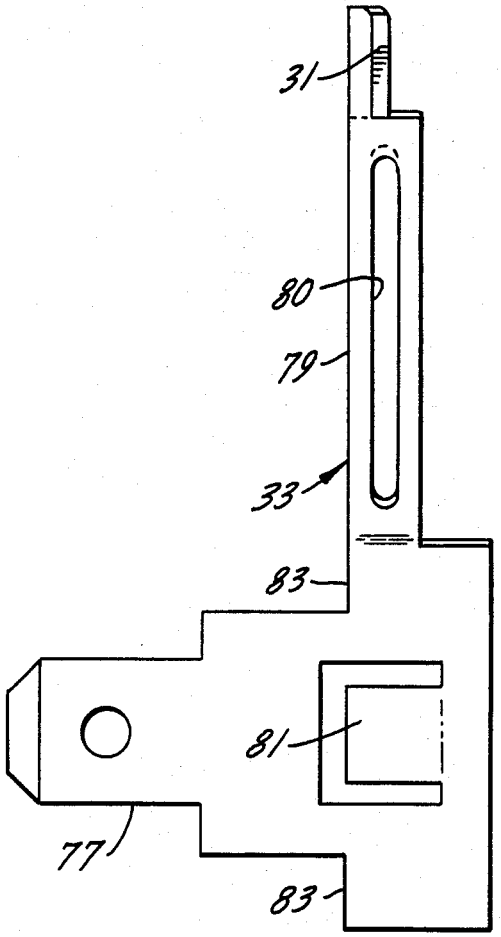
FIG. 4 is an enlarged plan view of the contact spring of the switch mechanism.

The contact spring 33 shown in enlarged detail in FIG. 4 of the drawings is formed of a phosphorous bronze material for wearing qualities and electrical conductivity. It is also an L-shaped member having its switch portion 31 and a quick connect terminal portion 77 located in the same plane and connected by an angularly offset arm portion 79. An elongated slot 80 is formed in the arm portion 79 to increase flexibility of the arm. The angular offset of the arm portion enables the contact 31 to engage the contact surface 29 of the actuator arm when the actuator arm 25 and contact spring 33 are positioned in the switch block assembly 35. An offset tab 81 formed at the base of the terminal portion 77 fits in a notch 45 in the center block 41 of the base portion 37 of the switch block assembly when its terminal portion 77 extends through the rectangular slot 61 formed in the cross member 55 of the top portion 51 of the block assembly. A shoulder 83 formed on the quick connect terminal engages the undersurface of the cross member 55 of the top portion 51 of the switch block assembly.

The top portion 51 is attached to the base portion 37 of the switch block assembly 35 after the actuator 25 and contact spring 33 have been installed with their terminals 67 and 77 extending through the slots 59 and 61 respectively. The top and base portions are secured together by heat staking the posts 39 at their conical depressions 47 to deform the posts over the rectangular blocks 53.

When the proper number of coins for a selected article of merchandise is inserted in the vending machine, a circuit will be closed in a microprocessor which will supply current to the sub-fractional horsepower direct current electric motor. Rotation of the electric motor causes movement of the gears in the gear train housing and consequent rotation of the output shaft. When the end 17 of the output shaft is in the at rest position shown in FIG. 1 of the drawings, the offset contact surface 29 of the actuator arm 25 is in electrical contact with the contact 31 of the contact spring 33 and the curved tip 27 of the actuator arm is resting on the flattened surface 21 of the cam surface 19 of the output shaft. As the output shaft rotates in a counterclockwise direction as viewed in FIG. 1 of the drawings, the actuator arm 25 and its offset contact surface 29 are moved out of electrical contact with the contact 31 of the contact spring 33. When the output shaft of the gear train completes one revolution, the curved tip 27 of the actuator arm which is riding on the cam surface 19 is returned to the flattened surface 21 of the cam surface and the offset contact surface 29 of the actuator arm is again brought into electrical contact with the contact 31 of the contact spring 33, thereby shorting the microprocessor circuit which is operating the electric motor. Thus the output shaft of the gear train is controlled through a predetermined cycle of operation and the the output shaft is accurately controlled at the end of each cycle of operation.

Manufacturing costs are reduced because of the simplified construction of the control switch assembly 23. Assembly costs are reduced because of the minimal number of parts forming the switch assembly and because a simple heat staking operation is used to complete the assembly. Reliability of operation of the switch is obtained by the cross point contact of the actuator arm and contact spring and the wiping action of the contact.

I claim:

1. A control mechanism in combination with an electric motor assembly which is intermittently operated through cycles of similar duration and in which an output shaft is connected to the electric motor through a gear train located in a housing, a cam surface formed on the output shaft, a switch block assembly located on the gear train housing, a first arm extending from the switch block assembly and having a contact near the free end thereof, a second arm extending from the switch block assembly and intersecting the free end of the first arm, the second arm having a cam follower portion which rides on the cam surface of the output shaft and a contact portion which is positioned to be moved into and out of engagement with the contact of the first arm, the cam surface of the output shaft being contoured so that the contacts of the first and second arms are disengaged when the output shaft begins a cycle of rotation and these contacts are engaged when the output shaft completes a cycle of rotation, said switch block assembly including a base portion formed integrally with the gear train housing, the base portion having a pair of posts and a center block located between the posts, and a switch top portion including a pair of blocks, a cross member connecting the blocks, a passage formed in each block which passages are adapted to receive the posts of the base portion with the cross member resting on the center block of the base portion and slots formed in the cross member and located between the base portion and the blocks, with the slots positioned to receive quick connect terminals extending therethrough.

2. The control mechanism of claim 1 in which said first arm has an integrally formed blade type terminal at the end thereof opposite to its free end, the blade type terminal including a blade portion which extends through a slot in the switch top portion cross member, a base portion with shoulders which engages the cross member outwardly of the slot and a tab on the base portion which engages the center block of the base portion.

3. The control mechanism of claim 2 in which the second arm has:

a blade type terminal integrally formed at the end opposite the cam follower portion end with the blade type terminal extending through a slot in the switch top portion cross member, and a base portion with shoulders which engage the cross member adjacent the slot and a tab on the base portion which engages the center block of the base portion.

4. The control mechanism of claim 3 in which the posts extend above the passages in the blocks and the posts are heat staked to the blocks.

* * * * *